US006120284A

United States Patent [19]

Good et al.

[11] Patent Number: 6,120,284

[45] Date of Patent: Sep. 19, 2000

[54] RECLAIMING FOUNDRY SAND BY GRAVITY FLOW SYSTEM

[75] Inventors: George E. Good, Highland, Mich.; Richard L. Martin, Windsor, Canada; Rodney G. Montrose, Winsor, Canada; Cameron A. Montrose, Windsor, Canada

[73] Assignee: Ford Global Technologies, Inc., Dearborn, Mich.

[21] Appl. No.: 08/996,167

[22] Filed: Dec. 22, 1997

[51] Int. Cl.[7] ..... F27D 1/00

[52] U.S. Cl. ..... 432/96; 432/97; 164/5; 164/456

[58] Field of Search ..... 432/96, 97, 99, 432/101; 164/5, 131, 132, 456; 134/19, 20

[56] References Cited

U.S. PATENT DOCUMENTS

| | | | |
|---|---|---|---|
| 4,144,088 | 3/1979 | Adams | 164/5 |
| 4,334,859 | 6/1982 | Minegishi et al. | 432/97 |
| 5,110,288 | 5/1992 | Rothschild et al. | 432/96 |
| 5,165,888 | 11/1992 | Rothschild et al. | 432/96 |
| 5,253,698 | 10/1993 | Keough et al. | 164/5 |

*Primary Examiner*—Denise L. Ferensic
*Assistant Examiner*—Gregory A. Wilson
*Attorney, Agent, or Firm*—David B. Kelley; Roger L. May

[57] ABSTRACT

A method of reclaiming foundry sand by (a) providing a treatment tower having a plurality of heat conductive tubes extending across the interior of the treatment tower, the tubes being arranged in rows and staggered with respect to tubes in adjacent rows to create close spacing therebetween sufficient to permit the sand to flow continuously and non-turbulently along the contours of the exterior under the influence of gravity before dropping to the next adjacent tube to thereby again flow continuously and non-turbulently in successive sequence downwardly of the tower; (b) quiescently heating the interior tower space and tubes to a temperature in excess of 1300° F. and introducing sufficient air or oxygen to permit combustion of the resin binder; and (c) feeding particulated sand to the top of the tower and tubes whereby such sand controllably flows along and through such labyrinth of tube spacings with little or no dwell on each contacted tube and in a time period of 5–15 seconds, said sand exiting from the bottom of said tower with said binder having been combusted to form a gas that is extracted from the top of the tower.

24 Claims, 4 Drawing Sheets

RECLAIMING FOUNDRY SAND BY GRAVITY FLOW SYSTEM

BACKGROUND OF THE INVENTION

1. Technical Field

This invention relates to the technology of foundry sand reclamation and more particularly to a more economic, nimble and robust gravity flow foundry sand reclamation system.

2. Discussion of the Prior Art

Calcining is an effective thermal process to reclaim resin bonded foundry sand. It is a thermal process that raises the temperature of the sand grains to a point where the spent organic resin coating is oxidized, leaving clean undamaged sand grains that are equal to new sand and can be reused in the foundry. Most sand reclaimers currently used in large foundries throughout the world are fluid bed type of calciners. This type of calciner heats large volumes of air to a calcining temperature and then passes such air through a bed of sand that is to be reclaimed. This procedure provides the temperature required to combust organic material and requires an extremely large volume of air for combustion as well as to fluidize the sand bed. Usually the resin coated sand is metered into the fluidized bed reclaimer from one end or side of the calciner and migrates through the reclaimer to flow out the reclaimer at the other end or side. Typically the air of a fluidized bed calciner is heated using natural gas or electric energy. The extremely large volume of heated air, containing the gaseous products of the resin, as well as particulate sand dust, must be treated to remove such contaminates before emissions can be discharged to the environment. This treatment may further include incineration, cooling and filtering. With the unusually large volume of gaseous emissions, the task can be expensive and formidable. Since these fluid bed type calciners are typically large refractory lined vessels with pressure fans and burner systems designed to move and heat large volumes of sand and fluidizing air, they must be operated continuously with a full load of fluidized sand and cannot be operated to empty or restarted very quickly. They consume large amounts of energy and require sizable emission control equipment due to the high volume of air used.

Recent attempts to substitute a gravity flow calcining system for a fluid bed type of system, to achieve better system control and flexibility, have not be entirely successful. One such gravity flow system is disclosed in related U.S. Pat. Nos. 5,110,288 and 5,165,888. The system of these patents requires a furnace chamber with combustion zones separated elevationally through the full height of the furnace chamber; the zones have radially directed burner units to turbulently and violently engage the sand that is quickly falling therethrough to attempt to combust the resin binder coating the sand particles. A few angled baffles extend across the furnace to attempt to slow down the descent of sand from one combustion zone to another. Unfortunately heat transfer to the resin coating on the sand grains must be entirely by convection which is not entirely effective in combusting all of the resin during the flow of sand through the combustion zones. It is necessary for the system to require a secondary chamber to carry out further combustion to complete the reclamation that was not fully carried out by the furnace. This is not energy efficient and results in undesirable production of ultra fine dust particles due to the turbulent collisions of the sand grains in the combustion zones that degrade the quality of the reclaimed sand.

SUMMARY OF THE INVENTION

It is an object of this invention to provide a foundry sand reclamation system that requires less energy consumption, minimal air use and minimal emission volume while producing a fully cleansed sand product of any sand type.

It is also an object of this invention to provide a sand reclamation apparatus that can be automatically operated at high volume throughput and operated to empty conditions without affecting a quick restart; it is a further object of this invention to provide a sand reclamation apparatus that lends itself to modularization permitting ease of increasing or decreasing the effective throughput to meet changing reclamation needs.

The method aspect of this invention that meets the above objects comprises the following steps:

(a) providing a treatment tower having a plurality of heat conductive tubes extending across the interior of the treatment tower, the tubes being arranged in rows and staggered with respect to tubes in adjacent rows to create close spacing therebetween sufficient to permit the sand to flow continuously and non-turbulently along the contours of the tube exterior under the influence of gravity before dropping to the next adjacent tube to thereby again flow continuously and non-turbulently in successive sequence downwardly of the tower;

(b) quiescently heating the interior tower space and tubes to a temperature in excess of 1300° F. and introducing sufficient air or oxygen to permit combustion of the resin binder; and (c) feeding particulated sand to the top of the tower and tubes whereby such sand controllably flows along and through such labyrinth of tube spacings with little or no dwell on each contacted tube and in a time period of 5–15 seconds, said sand exiting from the bottom of said tower with said binder having been combusted to form a gas that is extracted from the top of the tower.

In a second aspect of this invention an apparatus is provided for thermally reclaiming resin coated particulated sand, comprising;

(a) a treatment tower having a plurality of heat conductive stainless steel tubes extending across the interior of the treatment tower, the tubes being arranged in rows and staggered with respect to each other to create close spacing therebetween;

(b) fuel fired burner units stationed in the tower below the tubes to generate hot gases that quiescently rise and heat the tubes to a temperature level at or in excess of 1300° F.;

(c) a sand feeder stationed at the top of the tower to controllably admit a predetermined supply of particulated sand to the tubes of the tower whereby the sand flows along the contours of the tubes to be heated essentially by conduction to combust the resin coating and to produce cleansed sand and a gaseous emission that leaves the sand, the cleansed sand exiting from the tower bottom.

DESCRIPTION AND BEST MODE

Figure 1:
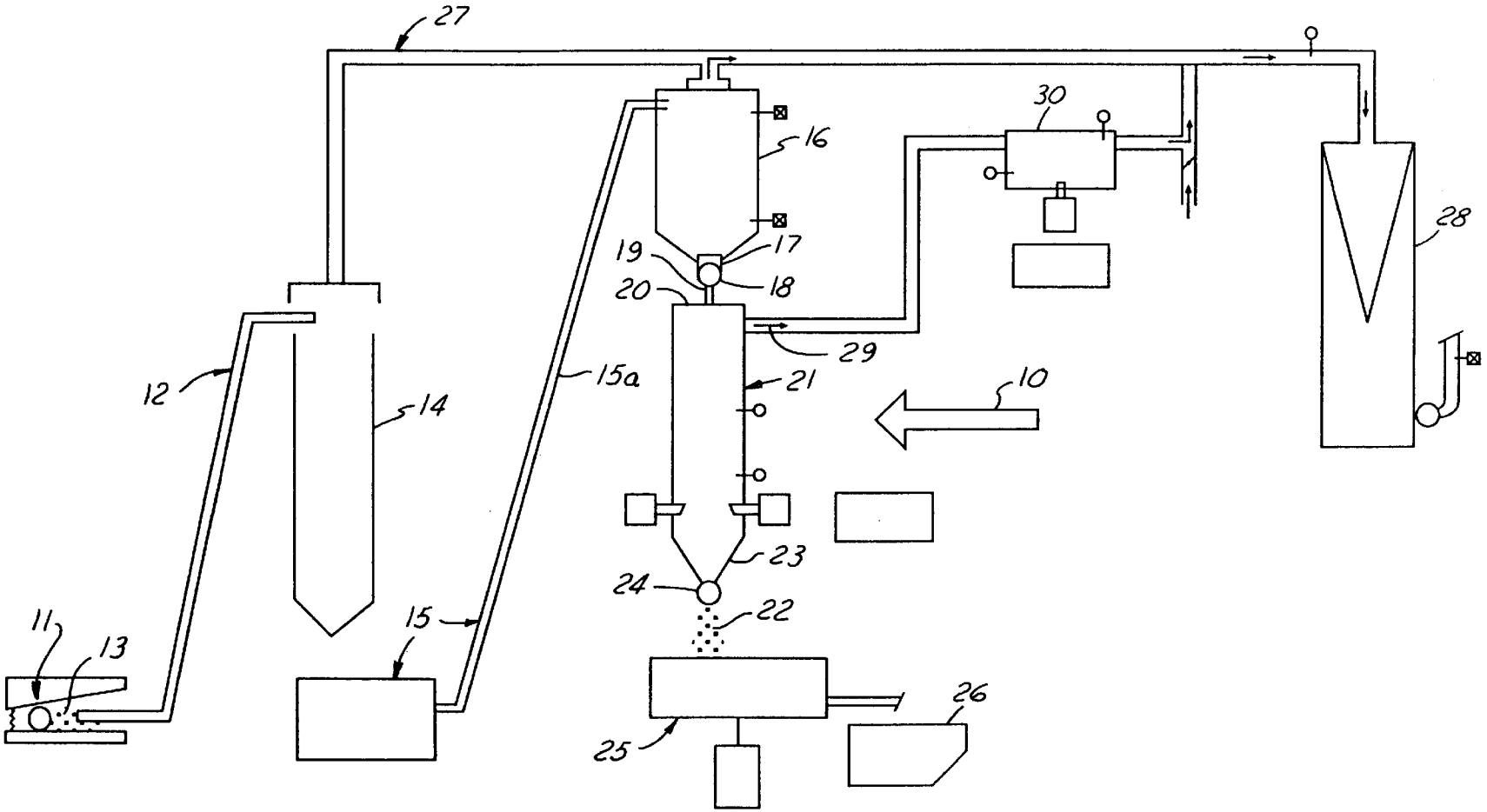
FIG. 1 is a schematic layout of the overall gravity flow foundry sand reclaiming system of this invention.
Figure 2:
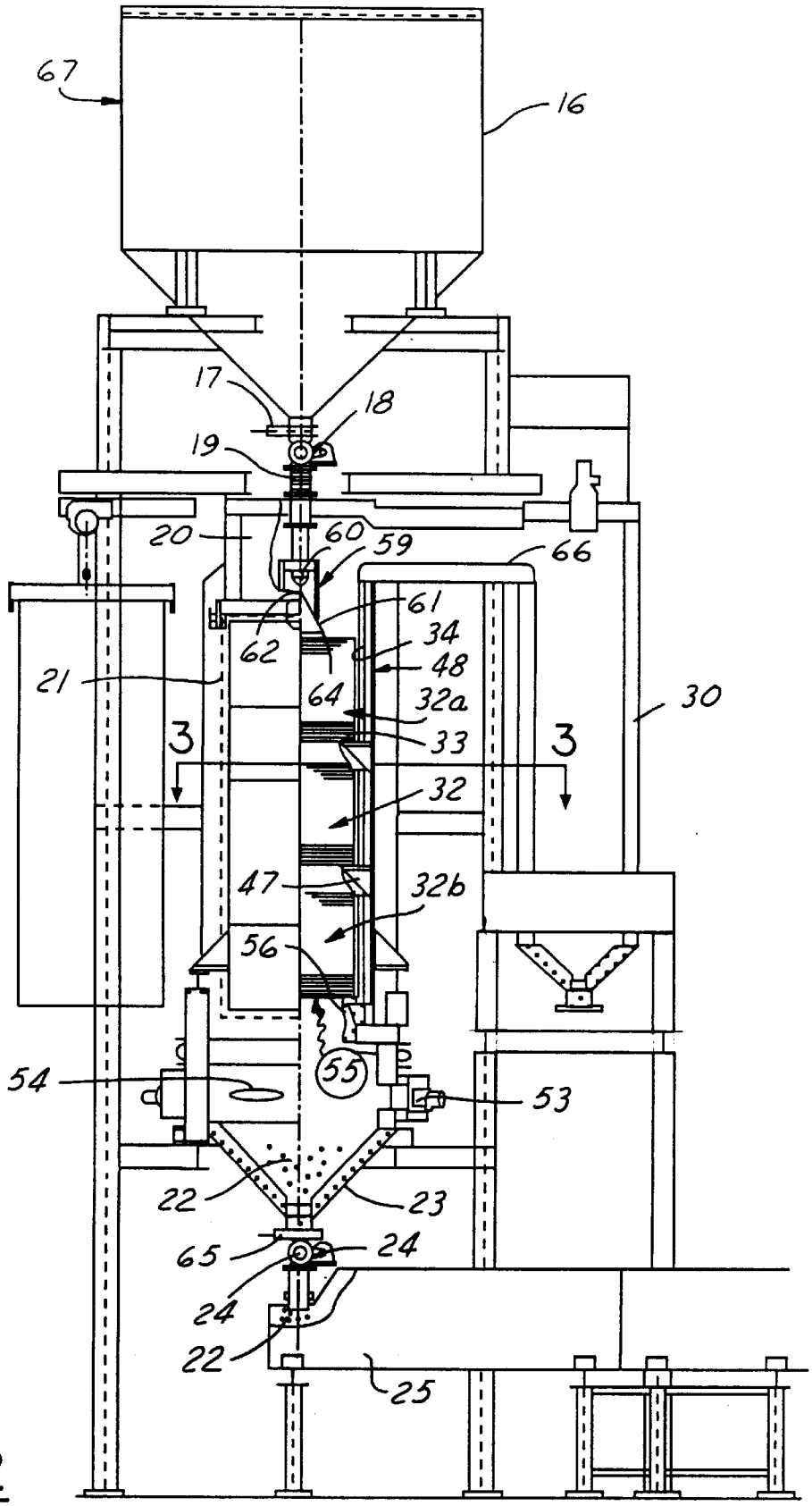
FIG. 2 is an enlarged partially sectioned elevational view of the gravity flow heating apparatus and emissions afterburner apparatus shown schematically in FIG. 1.
Figure 3:
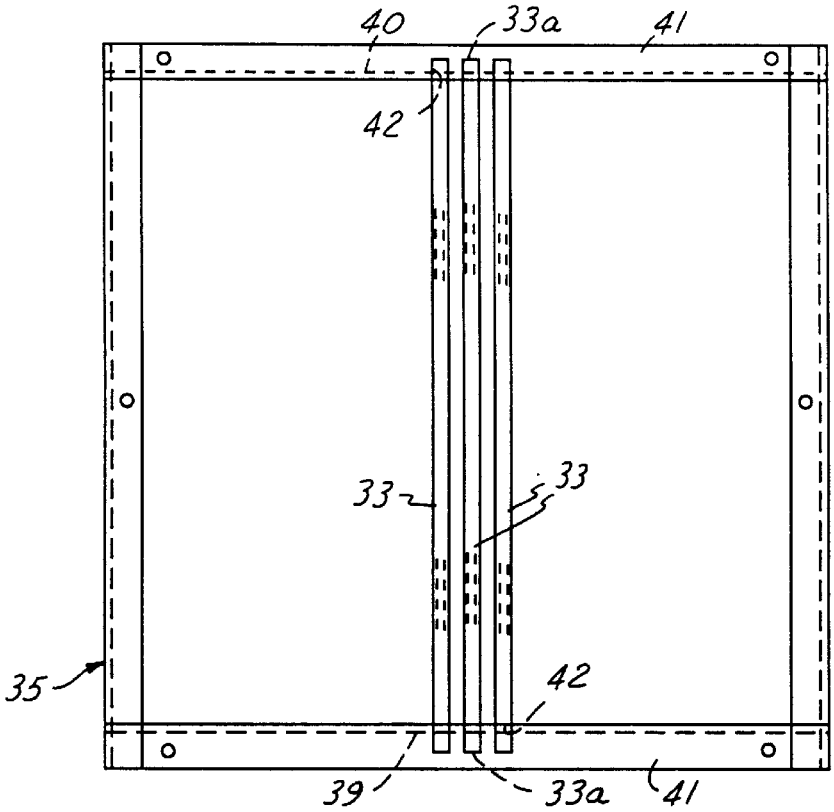
FIG. 3 is a further enlarged sectional view of one tube module taken along line 3—3 of FIG. 2.
Figure 4:
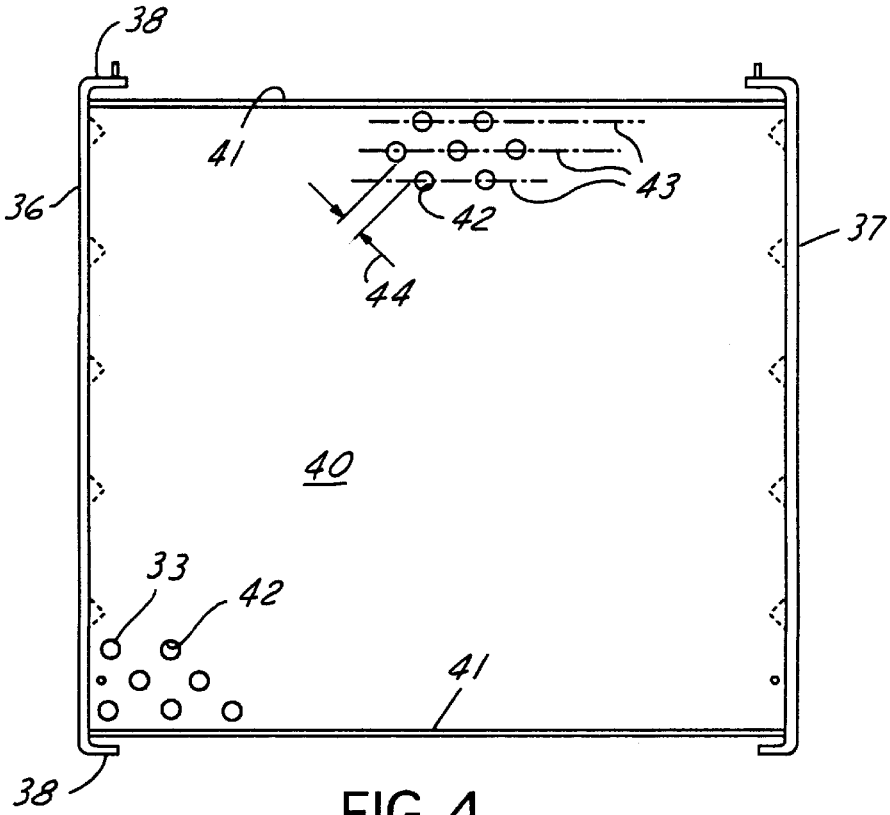
FIG. 4 is a side elevational view of the tube module shown in FIG. 3.

As shown in FIG. 1, the gravity flow sand reclamation system 10 of this invention comprises a sand lump breaker 11, a cam wall type conveyor 12 that transport the particulated sand 13 into a tube 14 from which the sand is disbursed to an air track elevating mechanism 15 that blows the sand through a conduit 15*a* to a storage hopper 16. Tube 14 can incorporate or be replaced by a magnetic metal-sand separating system. The sand is drawn from hopper 16 by opening a slide valve 17 and a rotary valve 18 admitting a selected quantity of sand through an expansion conduit 19 into the top 20 of the reclaiming tower 21. Sand falls by way of gravity and is distributed throughout the tower 21 to be cleansed; the cleansed sand 22 exits from the bottom 23 through another rotary valve 24 into a cooler classifier mechanism 25 and thence to a discharge hopper 26. Gaseous exhaust or emissions from the collection tank 14, hopper 16 and reclamation tower 21 are directed by passage 27 to a filter baghouse 28 before being released to the atmosphere; the exhaust 29 from the tower 21 is additionally treated by an afterburner apparatus 30 which converts the hydrocarbon content in the exhaust gases to water vapor and $CO_2$ prior to being quenched and sent to the baghouse 28.

The sand breaker 11 is effective to reduce the sand supply 13 to a particulate form having a size effective to pass through a screen of No. 9 mesh with 0.064 inch openings; particles smaller than 100 microns are separated as air born dust through the exhaust.

Turning now to FIGS. 2–5, the reclaiming or treatment tower 21 holds modules 32 of heat conductive tubes 33 extending across the interior 34 of the tower 21. Each module has a steel box frame 35 comprised of upper side walls 36, 37 (strengthened by inwardly facing flange 38 at the top and bottom which act as skids for the frame to slide on during installation or withdrawal); upright frame end walls 39, 40; and outwardly facing flange 41 (located at the top and bottom but spaced below the flange 38). Each end wall 39, 40 has a pattern of openings or perforations 42, aligned with the same pattern of openings on the opposite end wall to loosely receive the ends 33*a* of a stainless steel tube 33 which extends horizontally across the interior 34 of the tower. The holes are sized to loosely receive the ends 33*a*. A stainless steel tube 33 is inserted into each pair of aligned openings 42 on the end walls to create a labyrinth of closely spaced tubes.

The tubes 33 when supported in aligned pairs of openings are arranged in rows 43 and staggered with respect to tubes in adjacent rows to create the close spacing 44 which is sufficiently close but controlled to permit sand to flow continuously and non-turbulently along the arcuate contours 45 of each tube exterior when dropped thereon and before dropping to the next adjacent tube therebeneath to again flow continuously and non-turbulently on such successive tubes in sequence through the remainder of the tubes in the tower. The centers 46 of the oppositely paired openings 42 are placed in a pattern so that the narrowest gap 44 between adjacent tubes can occur on a line drawn between centers of the most adjacent tubes and adjacent rows. Such line is at an angle of about 45° to a vertical plane. To achieve this with openings having a diameter of about 1.18 inch, the centers in the same row may be spaced about 1.55 inches apart and the centers of the next row thereunder are placed at a vertical projection from the midpoint of the spacing above. The vertical distance between the centers of different rows is then arranged at about 1.13 inches.

The modules are carried into and placed onto their respective ledges 47 through a side access door 48. Three modules are here illustrated as stacked close to each other thus occupying a height of about 22 feet.

Figure 5:
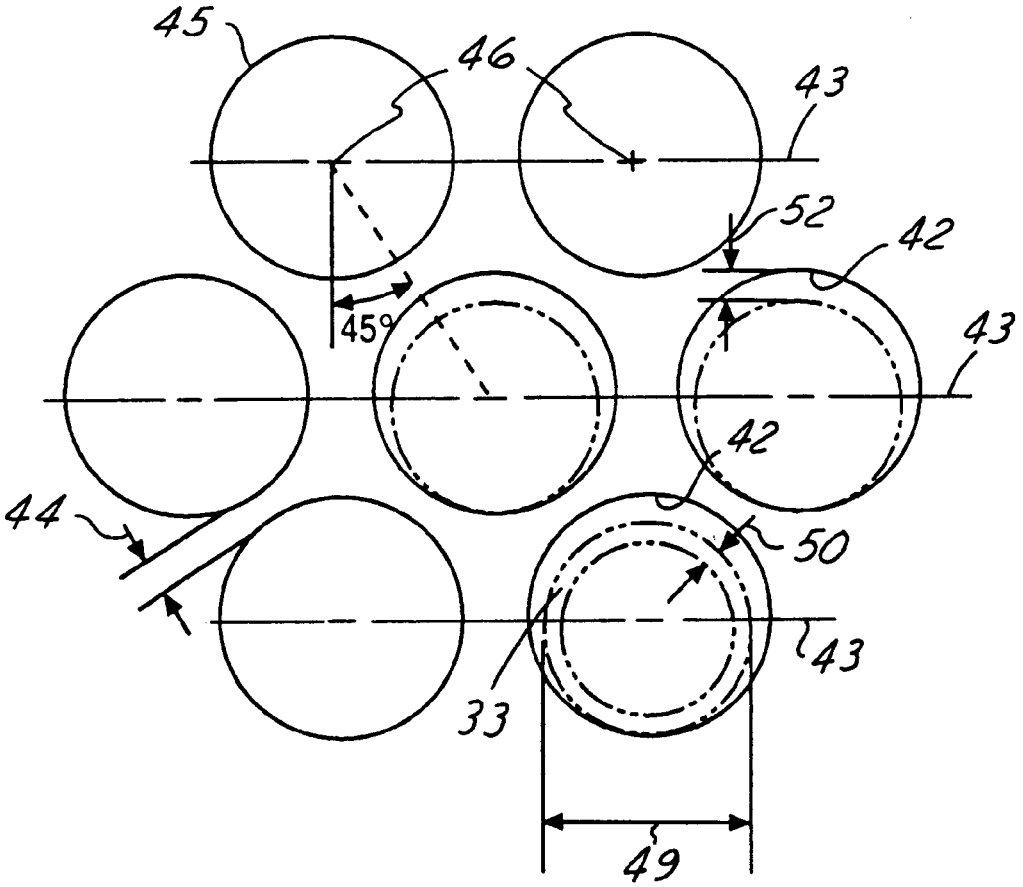
FIG. 5 is a greatly enlarged diagram of one portion of a tube array illustrating positioning and spacing of the tubes.

The tubes for example may have a circular exterior diameter 49 of about 1 inch with a wall thickness 50 of about 0.083 inches. For such tubes, the receiving or supporting openings would have an internal diameter of about 1.18 inches. As shown in FIG. 5, when a tube 33 is resting on the bottom 51 of an opening, a gap 52 of about 0.13 inches appears between the top of the tube and the top interior side of the opening. The tubes are thus free to thermally expand without fear of being seized within the opening and can actually rotate should certain tangential forces be applied to the tube exterior during use. The particular end wall 40 illustrated in FIG. 4 has about 28–29 openings in each horizontal row 43 and about 34 rows to provide a total of about 941–969 openings in each end wall.

The tubes have a cold rolled surface finish of about 10 micro-inch Rms, which is significantly slippery relative to sand dropped thereon. Sand slides off either side of each tube and will hug the tubes arcuately shaped surface as the sand slidingly maintains contact for a period of time to enhance conductive heat transfer therebetween; such contact may be as high as 80% of the time the sand is migrating from the top to the bottom of the tower.

Two gas fired burner units 53 (having a BTU output rating of about 2.5 mm.BTU/h each) are directed generally tangentially into the interior of the tower 21 (the tangent being on a circle meeting the midway points of all four sides of the tower). The burner units 53 inject a flame 54 along such tangent in a heavily insulated hearth 55 which is located beneath the tower of tubes. The burner units are located in a plane spaced about 3 feet below the bottom of the lowermost tube. The hearth 55 has a top opening 56 almost commensurate with the cross-sectional area of the tube module. Hot gases 57 rise from such burner units to convectively heat each of the tubes to a temperature of about 1100–1350° F. This is preferably carried out as a preheat step prior to introducing sand to the tower. The tubes of the lower most module 32*b* will be heated to a temperature of about 1300° or greater while tubes of the upper most module 32*a* will be heated to a temperature of about 1100–1150° F. The rising hot gases retain the heat content efficiently because the treating tower is lined with insulating layers of material having a thermal conductivity factor of about 0.687 BTU inch/ft$^2$.H-°F. The insulation is sufficiently effective to allow a person to touch the metal shell of the tower without being burned.

Particulated sand (of any type or hardness, i.e. silica or zircon) is fed into the top of the treating tower by way of a feeder 67 which consists of a funneled sand hopper 16, plate slide valve 17, rotary valve 18, and flexible expansion joint tube 19 leading to a distributing device 59. The distributing device 59 has a nozzle 60 that drops a stream of sand onto a conically shaped distributor 61 having its apex 62 pointing upwardly and aligned with the sand stream. Sand spreads downwardly along the cone exterior to provide an annular ring or annular sheet of sand that engages the tubes 33 stationed immediately below the cone skirt edge 64. Without the use of such distributing device, it would be difficult to achieve optimum efficiency for the treatment tower.

It takes the sand about 5–15 seconds to migrate downwardly through the labyrinth of tube spacings under the influence of gravity, to reach the bottom of the tower and thence pass through the hearth into the collection vessel 23. Slide valve 65 and rotary exit valve 24, attached to the vessel 23, are operated to pass cleansed sand 22 at a rate greater than the flow of sand through the rotary inlet valve 18, to thereby assure there is no buildup of sand in the hearth or tower. The inlet rotary valve 18 may be designed, for example, to pass 2 tons of particulated sand per hour. The cleansed sand 22 is transferred to the cooler 25 to reduce the sand temperature to about 100° F. Exhaust gases are taken off from the top of the tower to a relatively large tunnel 66 leading to the afterburner 30 and baghouse 28.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of cleansing sand of resin binder, comprising:

(a) providing a treatment tower having a top and a bottom and having a plurality of heat conductive tubes extending across the interior of the treatment tower, the tubes being arranged in rows and staggered with respect to tubes in adjacent rows to create close spacing therebetween, the spacing being sufficient to permit the sand to flow continuously and non-turbulently along the contours of the tube exteriors under the influence of gravity before dropping to the next adjacent tube to thereby again flow continuously and non-turbulently in successive sequence downwardly of the tower;

(b) quiescently heating the interior tower space and tubes to a temperature in excess of at least 1100–1300° F. and introducing sufficient air or oxygen to permit combustion of the resin binder; and (c) feeding particulated sand to the top of the tower of tubes whereby such sand controllably flows along and through said spacings of tubes with little or no dwell on each contacted tube, the sand traversing the height of the tower in a time period of 5–15 seconds, said sand exiting from the bottom of said tower with said binder having been combusted to form a gas that is extracted from the top of the tower, wherein said sand flow hugs the tube exteriors 80% of the time when migrating from the top to the bottom of the tower.

2. The method as in claim 1, in which said tubes are circular in cross-section.

3. The method as in claim 2, in which said tubes have a diameter of about 1 inch.

4. The method as in claim 3, in which the centers of said tubes are spaced apart a distance of about 1.5 inches within a row and are spaced apart a distance of about 1.2 inches in a vertical direction.

5. The method as in claim 1, in which said tubes are spaced apart a distance of about 0.2–0.35 inches at the closest spacing.

6. The method as in claim 1, in which the tubes are arranged in rows numbering at least 30 with the tubes in each row numbering at least 28.

7. The method as in claim 1, in which each tube is comprised of stainless steel having a surface finish of about 10 microinch Rms.

8. The method as in claim 7, in which said tubes have a uniform thickness of about 0.083 inches.

9. The method as in claim 1, in which said heating is carried out by use of tangentially directed burners that produce hot gasses rising to convectively heat the tubes and the air within the tower.

10. The method as in claim 1, in which said tubes are supported in removable rack modules.

11. The method as in claim 10, in which the rack modules have openings supporting the tubes in a loose manner to cradle the tubes allowing for thermal expansion.

12. The method as in claim 1, in which the step of feeding particulated sand is carried out with the use of a distributing device that drops the sand in a circular pattern across an extended portion of the uppermost tubes.

13. The method as in claim 1, in which said method reduces the energy consumption for carrying out the process by use of an insulated interior tower and by preheating the tubes to said temperature prior to sand feedings.

14. An apparatus for thermally reclaiming resin coated particulated sand comprising:

(a) a tower having a top and a bottom and having a plurality of heat conductive tubes extending across the interior of the tower, the tubes being arranged in rows and staggered with respect to tubes in adjacent rows to create close spacing therebetween sufficient to permit the sand to flow continuously and non-turbulently along the contours of the tube exteriors under the influence of gravity, said flow dropping to the next adjacent tubes to thereby again flow continuously and non-turbulently in successive sequence downwardly throughout the remainder of the tower;

(b) fuel fired burner units stationed in the tower below the tubes to generate hot gasses that quiescently rise and heat the tubes to a temperature level at or in excess of 1100–1300° F.;

(c) a sand feeder stationed at the top of the tower to controllably admit a predetermined supply of particulated sand to the tubes of the tower, the sand being admitted after and while the tubes have been heated to said temperature by said burner units, whereby said sand admitted by said feeder will flow along the contours of the tubes to be heated essentially by conduction to combust the resin coating and thereby produce cleansed sand and a gaseous emission that leaves the sand; and a sand breaker for reducing the sand supply to a particulated form having a size effective to pass through a screen of about No. 9 mesh, but particles smaller than 100 micron being separated as dust.

15. The apparatus as in claim 14, which further comprises a cooler to reduce the cleansed sand to a temperature of about 100° F., and an afterburner to convert the gaseous emissions to water vapor and carbon dioxide while filtering dust therefrom.

16. The apparatus as in claim 14, in which said fuel fire burner units are arranged tangentially with respect to the interior peripheral of the tower bottom to create a non-turbulent flow of hot gases upwardly therefrom.

17. The apparatus as in claim 14, in which the tower bottom has converging walls funneling the sand to a discharge valve, the flow rate from said discharge valve being greater than the flow rate through the inlet valve to the top of the tower.

18. A method of cleansing sand of resin binder, comprising:

(a) providing a treatment tower having a top and a bottom and having a plurality of heat conductive tubes extending across the interior of the treatment tower, the tubes being circular in cross-section and arranged in rows and staggered with respect to tubes in adjacent rows to create close spacing therebetween, the spacing being sufficient to permit the sand to flow continuously and non-turbulently along the contours of the tube exteriors under the influence of gravity before dropping to the next adjacent tube to thereby again flow continuously and non-turbulently in successive sequence downwardly of the tower;

(b) quiescently heating the interior tower space and tubes to a temperature in excess of at least 1100–1300° F. and introducing sufficient air or oxygen to permit combustion of the resin binder; and (c) feeding particulated sand to the top of the tower of tubes whereby such sand controllably flows along and through said spacings of tubes with little or no dwell on each contacted tube, the sand traversing the height of the tower in a time period of 5–15 seconds, said sand exiting from the bottom of said tower with said binder having been combusted to form a gas that is extracted from the top of the tower.

19. A method of cleansing sand of resin binder, comprising:

(a) providing a treatment tower having a top and a bottom and having a plurality of heat conductive tubes extending across the interior of the treatment tower, the tubes being spaced apart a distance of about 0.2–0.35 inches at the closest spacing and being arranged in rows and staggered with respect to tubes in adjacent rows to create close spacing therebetween, the spacing being sufficient to permit the sand to flow continuously and non-turbulently along the contours of the tube exteriors under the influence of gravity before dropping to the next adjacent tube to thereby again flow continuously and non-turbulently in successive sequence downwardly of the tower;

(b) quiescently heating the interior tower space and tubes to a temperature in excess of at least 1100–1300° F. and introducing sufficient air or oxygen to permit combustion of the resin binder; and (c) feeding particulated sand to the top of the tower of tubes whereby such sand controllably flows along and through said spacings of tubes with little or no dwell on each contacted tube, the sand traversing the height of the tower in a time period of 5–15 seconds, said sand exiting from the bottom of said tower with said binder having been combusted to form a gas that is extracted from the top of the tower.

20. A method of cleansing sand of resin binder, comprising:

(a) providing a treatment tower having a top and a bottom and having a plurality of heat conductive tubes extending across the interior of the treatment tower, the tubes being arranged in rows and staggered with respect to tubes in adjacent rows to create close spacing therebetween, the tubes being arranged in rows numbering at least 30 and staggered with respect to the tubes, which number at least 28 to create close spacing between the tubes, the spacing being sufficient to permit the sand to flow continuously and non-turbulently along the contours of the tube exteriors under the influence of gravity before dropping to the next adjacent tube to thereby again flow continuously and non-turbulently in successive sequence downwardly of the tower;

(b) quiescently heating the interior tower space and tubes to a temperature in excess of at least 1100–1300° F. and introducing sufficient air or oxygen to permit combustion of the resin binder; and (c) feeding particulated sand to the top of the tower of tubes whereby such sand controllably flows along and through said spacings of tubes with little or no dwell on each contacted tube, the sand traversing the height of the tower in a time period of 5–15 seconds, said sand exiting from the bottom of said tower with said binder having been combusted to form a gas that is extracted from the top of the tower.

21. A method of cleansing sand of resin binder, comprising:

(a) providing a treatment tower having a top and a bottom and having a plurality of heat conductive tubes extending across the interior of the treatment tower, the tubes being stainless steel having a surface finish of about 10 microinch Rms and being arranged in rows and staggered with respect to tubes in adjacent rows to create close spacing therebetween, the spacing being sufficient to permit the sand to flow continuously and non-turbulently along the contours of the tube exteriors under the influence of gravity before dropping to the next adjacent tube to thereby again flow continuously and non-turbulently in successive sequence downwardly of the tower;

(b) quiescently heating the interior tower space and tubes to a temperature in excess of at least 1100–1300° F. and introducing sufficient air or oxygen to permit combustion of the resin binder; and (c) feeding particulated sand to the top of the tower of tubes whereby such sand controllably flows along and through said spacings of tubes with little or no dwell on each contacted tube, the sand traversing the height of the tower in a time period of 5–15 seconds, said sand exiting from the bottom of said tower with said binder having been combusted to form a gas that is extracted from the top of the tower.

22. A method of cleansing sand of resin binder, comprising:

(a) providing a treatment tower having a top and a bottom and having a plurality of heat conductive tubes extending across the interior of the treatment tower, said tubes being supported in removable rack modules, the tubes being arranged in rows and staggered with respect to tubes in adjacent rows to create close spacing therebetween, the spacing being sufficient to permit the sand to flow continuously and non-turbulently along the contours of the tube exteriors under the influence of gravity before dropping to the next adjacent tube to thereby again flow continuously and non-turbulently in successive sequence downwardly of the tower;

(b) quiescently heating the interior tower space and tubes to a temperature in excess of at least 1100–1300° F. and introducing sufficient air or oxygen to permit combustion of the resin binder; and (c) feeding particulated sand to the top of the tower of tubes whereby such sand controllably flows along and through said spacings of tubes with little or no dwell on each contacted tube, the sand traversing the height of the tower in a time period of 5–15 seconds, said sand exiting from the bottom of said tower with said binder having been combusted to form a gas that is extracted from the top of the tower.

23. A method of cleansing sand of resin binder, comprising:

(a) providing a treatment tower having a top and a bottom and having a plurality of heat conductive tubes extending across the interior of the treatment tower, the tubes being arranged in rows and staggered with respect to tubes in adjacent rows to create close spacing therebetween, the spacing being sufficient to permit the sand to flow continuously and non-turbulently along the contours of the tube exteriors under the influence of gravity before dropping to the next adjacent tube to thereby again flow continuously and non-turbulently in successive sequence downwardly of the tower;

(b) quiescently heating the interior tower space and tubes to a temperature in excess of at least 1100–1300° F. and introducing sufficient air or oxygen to permit combustion of the resin binder; and (c) feeding particulated sand to the top of the tower of tubes whereby such sand controllably flows along and through said spacings of tubes with little or no dwell on each contacted tube, the sand traversing the height of the tower in a time period of 5–15 seconds, said sand exiting from the bottom of said tower with said binder having been combusted to form a gas that is extracted from the top of the tower, wherein the step of feeding particulated sand is carried out with the use of a distributing device that drops the sand in a circular pattern across an extended portion of the uppermost tubes.

24. An apparatus for thermally reclaiming resin coated particulated sand comprising:

(a) a tower having a top and a bottom and having a plurality of heat conductive tubes extending across the interior of the tower, the tubes being arranged in rows and staggered with respect to tubes in adjacent rows to create close spacing therebetween sufficient to permit the sand to flow continuously and non-turbulently along the contours of the tube exteriors under the influence of gravity, said flow dropping to the next adjacent tubes to thereby again flow continuously and non-turbulently in successive sequence downwardly throughout the remainder of the tower;

(b) fuel fired burner units stationed in the tower below the tubes to generate hot gasses that quiescently rise and heat the tubes to a temperature level at or in excess of 1100–1300° F.;

(c) a sand feeder stationed at the top of the tower to controllably admit a predetermined supply of particulated sand to the tubes of the tower, the sand being admitted after and while the tubes have been heated to said temperature by said burner units, whereby said sand admitted by said feeder will flow along the contours of the tubes to be heated essentially by conduction to combust the resin coating and thereby produce cleansed sand and a gaseous emission that leaves the sand; and (d) a cooler to reduce the cleansed sand to a temperature of about 100° F., and an afterburner to convert the gaseous emissions to water vapor and carbon dioxide while filtering dust therefrom.

* * * * *